US006622705B2

(12) United States Patent
Stier et al.

(10) Patent No.: US 6,622,705 B2
(45) Date of Patent: Sep. 23, 2003

(54) METHOD FOR OPERATING A FUEL INJECTION VALVE

(75) Inventors: Hubert Stier, Asperg (DE); Norbert Keim, Loechgau (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/958,370

(22) PCT Filed: Feb. 2, 2001

(86) PCT No.: PCT/DE01/00438

§ 371 (c)(1),
(2), (4) Date: Apr. 3, 2002

(87) PCT Pub. No.: WO01/57391

PCT Pub. Date: Aug. 9, 2001

(65) Prior Publication Data

US 2002/0148448 A1 Oct. 17, 2002

(30) Foreign Application Priority Data

Feb. 4, 2000 (DE) ..... 100 05 015

(51) Int. Cl.[7] ..... F02M 51/06
(52) U.S. Cl. ..... 123/490; 361/154
(58) Field of Search ..... 123/490; 361/154

(56) References Cited

U.S. PATENT DOCUMENTS 5,531,198 A * 7/1996 Matsuura ..... 123/490 X
5,986,871 A * 11/1999 Forck et al. ..... 361/154 X

FOREIGN PATENT DOCUMENTS

DE 196 26 576 1/1998
JP 2-230952 * 9/1990 ..... 239/533.9

* cited by examiner

*Primary Examiner*—Tony M. Argenbright
(74) *Attorney, Agent, or Firm*—Kenyon & Kenyon

(57) ABSTRACT

A method is described for operating a fuel injector for fuel injection systems of internal combustion engines, particularly for the direct injection of fuel into a combustion chamber of an internal combustion engine. The fuel injector has a magnetic coil, an armature acted upon in a closing direction by a resetting spring, and a valve needle, frictionally connected to the armature, for actuating a valve-closure member which, together with a valve-seat surface, forms a sealing seat. The method includes exciting the magnetic coil with a basic current intensity during an opening phase of the fuel injector, shortly before the end of the opening phase, exciting the magnetic coil with a current pulse that is increased compared to the basic current intensity, and, at the end of the opening phase, switching off the current exciting the magnetic coil.

12 Claims, 2 Drawing Sheets

METHOD FOR OPERATING A FUEL INJECTION VALVE

FIELD OF THE INVENTION

The present invention relates to a method for operating a fuel injector.

BACKGROUND INFORMATION

An electromagnetically operable fuel injector for the direct injection of fuel into the combustion chamber of an internal combustion engine is described in German Patent Application No. 196 26 576. In this fuel injector, an armature cooperates with an electrically energizable magnetic coil for the electromagnetic actuation. The lift of the armature is transferred via a valve needle to a valve-closure member. The valve-closure member cooperates with a valve-seat surface to form a sealing seat. The valve needle and the valve-closure member are reset by a resetting spring.

The relatively long closing times are disadvantageous in the fuel injector described in German Patent Application No. 196 26 576 A1. Delays in closing the fuel injector are caused by the adhesive powers acting between the armature and the core, and the non-instantaneous decay of the magnetic field in response to switching off the excitation current. Therefore, the resetting spring must have a large spring constant or a great bias (prestressing). To-achieve shorter closing times, the restoring force must be dimensioned to be substantially greater than would be necessary for sealing against the combustion chamber pressure. This involves a great power demand of the electronic trigger circuit.

SUMMARY

A method according to the present invention for operating a fuel injector has the advantage that an additional current pulse at the end of the opening phase has a positive effect on the closing operation. In the final phase of the opening interval, the total spring energy acting in the closing direction is increased by the additional current pulse.

Due to the additional cutoff spring, an additional accelerative force is available during the closing operation to quickly close the fuel injector. The spring constant of the resetting spring is dimensioned in such a way that the spring energy exerted still safely suffices to seal the fuel injector against the pressure in the combustion chamber of the internal combustion engine.

The method is particularly advantageous in the low speed range of the internal combustion engine, since in this range, one strives for the metering of small amounts of fuel at relatively long time intervals.

Thermal overloading of the fuel injector and of the electrical component is virtually ruled out, since the current pulses are only supplied over very short periods of time with long pauses between.

By supplying a current pulse, the magnetic field is built up again to a higher magnetic-field value, which offers the advantage—relatively considered—of the rapid reduction in the periods of time relevant for the closing operation, since the magnetic field decreases approximately exponentially with the time.

The cutoff spring can be replaced by applying an elastically deformable layer on the armature stop face of the core and/or of the armature, since deformation energy can be stored in the elastically deformable layer which acts like a spring with a very high spring constant. This energy is available again for the closing operation.

DETAILED DESCRIPTION OF AN EXAMPLE EMBODIMENT

Figure 1:
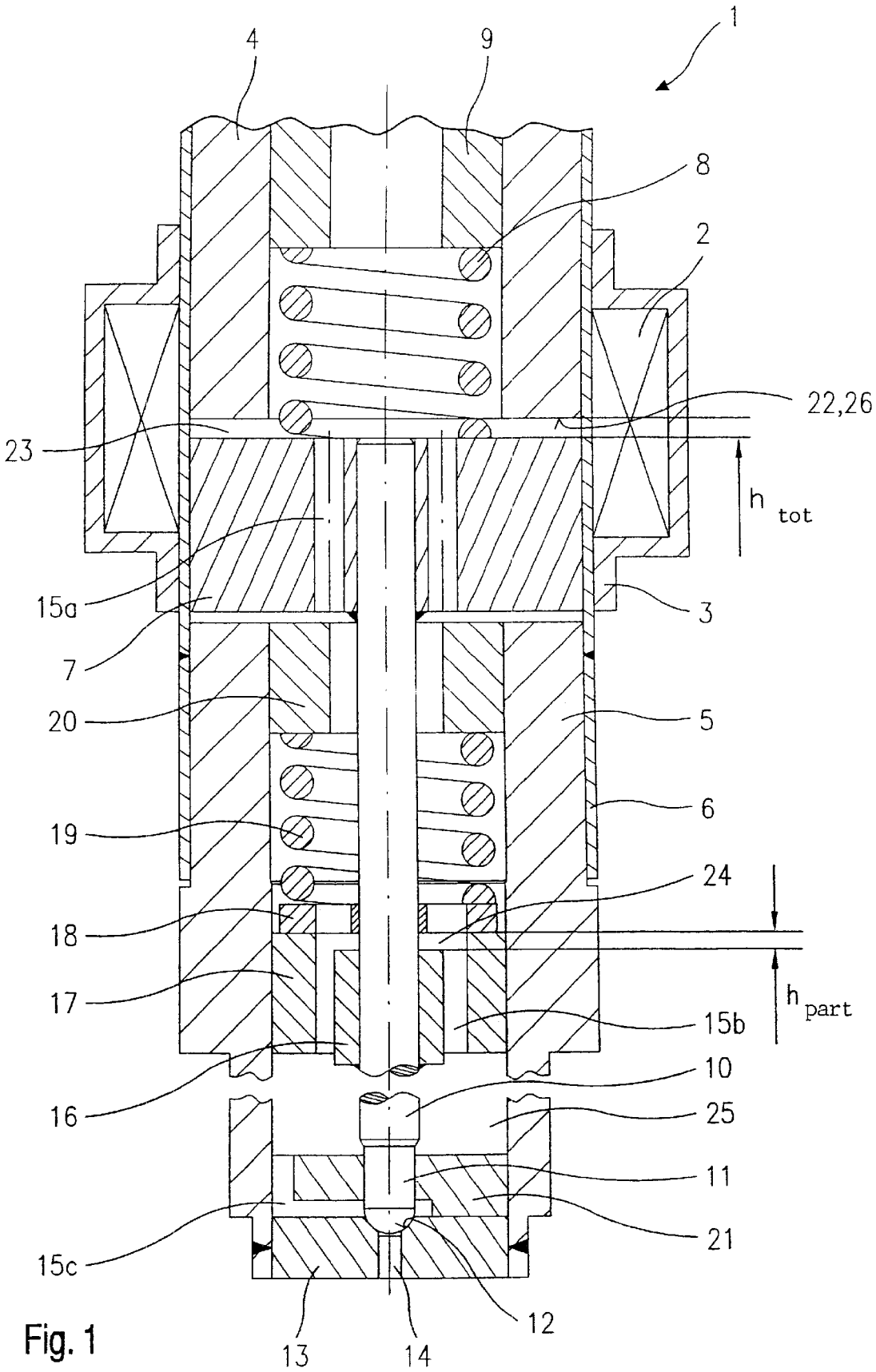
FIG. 1 shows a sectional view of an example embodiment of a fuel injector for implementing the example method of the present invention.

FIG. 1 shows an axial sectional view the region of a fuel injector 1 on the spray-discharge side. Fuel injector 1 is used, for example, for the direct injection of fuel into a combustion chamber (not shown) of a mixture-compressing internal combustion engine with externally supplied ignition, and is designed as an inwardly opening fuel injector 1.

Fuel injector 1 includes a magnetic coil 2, that is surrounded by a magnetic reflux member 3, as well as a core 4 and a nozzle body 5 that are surrounded by a valve housing 6. Arranged between core 4 and nozzle body 5 is an armature 7 that is acted upon by a resetting spring 8. Resetting spring 8 abuts at the extremity against an adjusting sleeve 9 which biases resetting spring 8. Armature 7 is connected frictionally and with form locking to a valve needle 10, at whose end on the spray-discharge side a valve-closure member 11 is formed. Valve-closure member 11, together with a valve-seat surface 12, forms a sealing seat. At least one spray orifice 14 is formed in a valve-seat member 13.

Valve needle 10 is guided in the region of the sealing seat by a guide element 21. The fuel is supplied centrally and is guided via fuel channels 15*a*, 15*b*, 15*c* to the sealing seat.

A tubular valve-needle end stop 16 is joined to valve needle 10. Situated on a bearing ring 17, which is applied on the inner wall of nozzle body 5 and can be pressed, for example, into a central opening 25 of fuel injector 1, is an axially movable ring 18 through which valve needle 10 protrudes. Supported on ring 18 is a cutoff spring 19 that is biased by a spring-adjusting ring 20 likewise applied on the inner wall of nozzle body 5. In fuel injector 1 shown in FIG. 1, cutoff spring 19 is constructed as helical spring 19.

A total lift $h_{tot}$ corresponds to the size of a first working gap 23 formed between armature 7 and core 4. A partial lift $h_{part}$ corresponds to the size of a second working gap 24 formed between valve-needle end stop 16 and movable ring 18. In the present example, partial lift $h_{part}$ is approximately 90% of total lift $h_{tot}$.

If an electrical excitation current is supplied to magnetic coil 2, a magnetic field is built up which pulls armature 7 in the lift direction to core 4. Armature 7 takes along valve needle 10 joined to it. While armature 7 and valve needle 10 are passing through partial lift $h_{part}$, the magnetic-field strength only has to overcome the spring energy of weakly dimensioned resetting spring 8, so that armature 7 can be accelerated in the direction of core 4. The spring constant of resetting spring 8 is dimensioned in such a way that the spring energy safely suffices to seal fuel injector 1 against the combustion chamber (not shown) of an internal combustion engine.

After armature 7 and valve needle 10 joined to it have covered partial lift $h_{part}$, valve-needle end stop 16 strikes against movable ring 18 acted upon by cutoff spring 19.

As soon as armature 7 moves in the direction of core 4, valve-closure member 11 lifts off of valve-seat surface 12 and fuel is ejected via spray orifice 14.

During the opening phase, the striking of valve-needle end stop 16 against ring 18 limits the valve lift, so that valve-closure member 11 in the open state of fuel injector 1 is only raised by the amount of partial lift $h_{part}$.

Shortly before fuel injector 1 is closed, residual lift $h_{tot}-h_{part}$ is covered against the spring energies of resetting spring 8 and cutoff spring 19, which is achieved by a short-duration increase, in the form of a current pulse, of the current exciting magnetic coil 2,. Armature 7 and valve needle 10 are raised by this current pulse shortly before the end of the opening phase, whereby valve-needle end stop 16 lifts movable ring 18 from bearing ring 17 in the lift direction against the spring energy of cutoff spring 19. Since the spring energies of resetting spring 8 and of cutoff spring 19 add up, the total spring energy of resetting spring 8 and of cutoff spring 19 is available at the end of the opening phase for closing fuel injector 1, this total spring energy, due to the large spring constant of cutoff spring 19, being considerably greater than the restoring force achieved in the related art by single resetting spring 8.

If the electrical excitation current exciting magnetic coil 2 is switched off, the magnetic field breaks down and armature 7 falls off of core 4. This can happen very quickly, since the total spring energy of resetting spring 8 and of cutoff spring 19 together accelerate armature 7 in the closing direction, enabling valve needle 10 to return very quickly to its closed position.

This effect can also be achieved by applying an elastically deformable layer 26 on an armature stop face 22 of core 4 and/or on armature 7, so that cutoff spring 19 can be omitted. Elastically deformable layer 26 acts like a spring with extremely high spring stiffness, so that an elastic deformation of armature stop face 22 due to the current pulse leads to the rapid detachment of armature 7 from core 4, as well as a rapid closing movement of fuel injector 1.

Figure 2A:
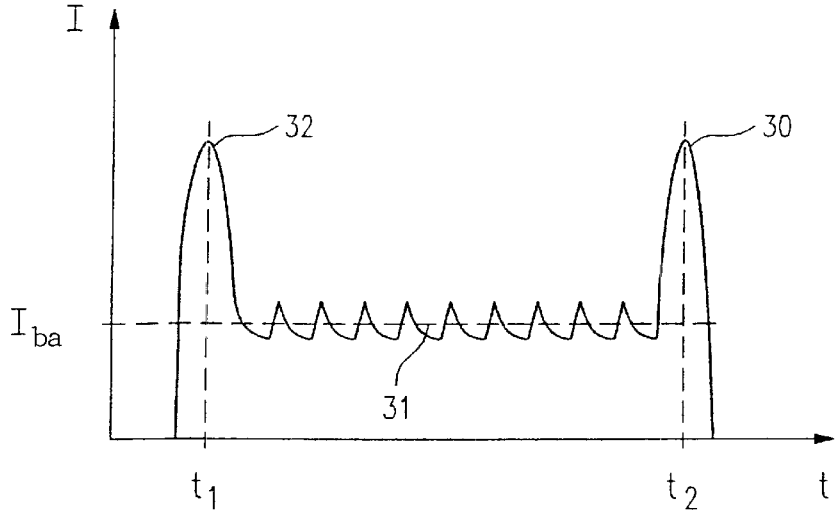
FIGS. 2A–2C show diagrams of the characteristics of the excitation current, of the spring energy and of the lift as a function of the trigger time for the example method of the present invention.
Figure 2B:
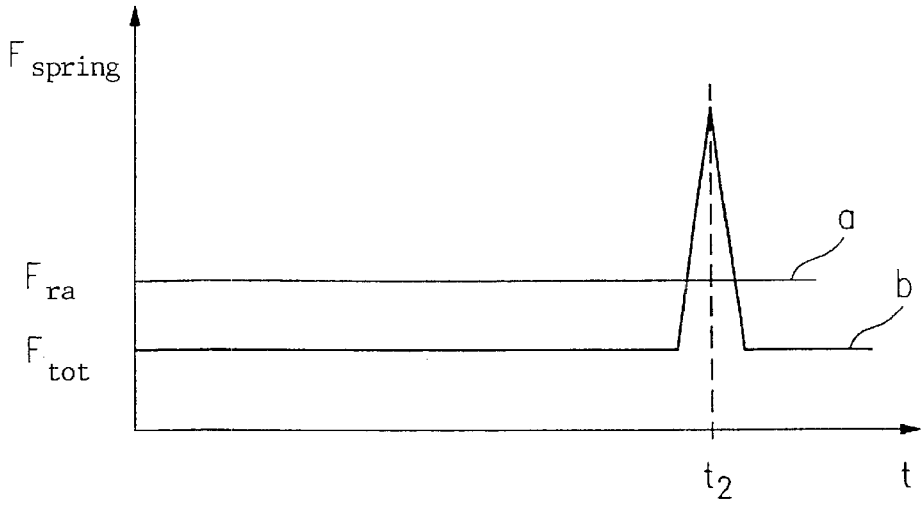
Figure 2C:
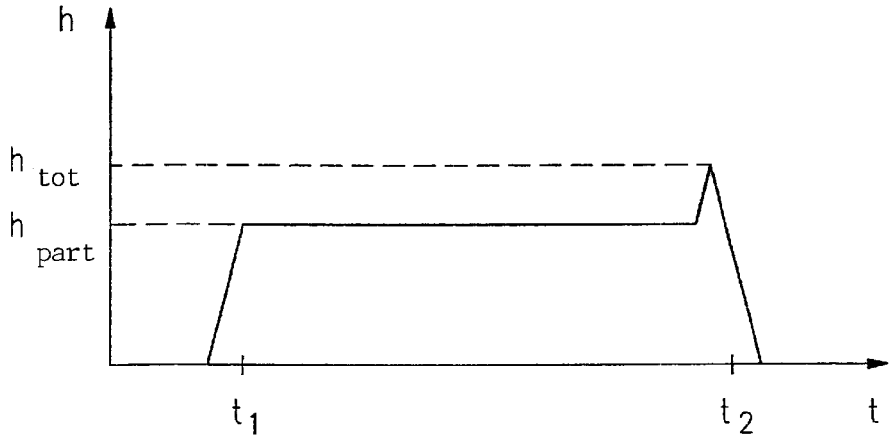

For the purpose of illustrating the operating mode of the current pulse, FIGS. 2A–2C show excitation current I, spring energy $F_{spring}$ and valve lift h, in each case as a function of time t.

FIG. 2A shows current intensity I, exciting magnetic coil 2, as a function of time t. Following current pulse 32, supplied for initiating the opening operation, at instant $t_1$ is a phase 31 during which magnetic coil 2 is operated with a basic current intensity $I_{ba}$ that is constant on average, until shortly before the end of the opening phase a current pulse 30 is again supplied at instant $t_2$ for overcoming cutoff spring 19. Excitation current I is thereupon switched off, which means after a brief time interval after sufficient reduction of the magnetic field, the closing operation begins. The brevity of current pulse 30 ensures that a maximum value for the electric power in the electrical trigger circuit is not exceeded, and consequently the electrical components are not damaged by thermal overloading.

FIG. 2B shows spring energy $F_{spring}$ as a function of trigger time t. Diagram 2B includes a curve a which describes spring energy $F_{ra}$ according to the related art using a single resetting spring 8, as well as a curve b which shows the dependence of total spring energy $F_{tot}$ of resetting spring 8 and of cutoff spring 19 as a function of time t for the example, described in FIG. 1, of a fuel injector 1 suitable for carrying out the method of the present invention.

Spring energy $F_{ra}$ of resetting spring 8 in curve a is greater than spring energy $F_{tot}$ of resetting spring 8 in curve b, since the spring energy of resetting spring 8 according to the related art is the only force which pulls armature 7 from core 4 after sufficient decay of the magnetic field. In the case of fuel injector 1 suitable for carrying out the method of the present invention, the spring energy of resetting spring 8 is reduced to a value which is great enough to reliably seal fuel injector 1 against the pressure prevailing in the combustion chamber of the internal combustion engine. A shortened opening operation is thereby attained. The force necessary for the rapid closing is contributed by cutoff spring 19 which is overcome by current pulse 30, and consequently total spring energy $F_{tot}$ is increased for a short duration to a considerably greater value than in the related art due to supplied current pulse 30.

FIG. 2C shows valve lift h as a function of time t. The flow of current through magnetic coil 2 accelerates armature 7 against the spring energy of resetting spring 8 in the direction toward core 4. At instant $t_1$, the armature has passed through partial lift $h_{part}$. Valve-needle end stop 16 strikes against ring 18. Current intensity I now remains constant at value $I_{ba}$, fuel injector 1 thereby remaining in the partially opened position. Current intensity $I_{ba}$ is not sufficient to move armature 7 against total spring energy $F_{tot}$ of resetting spring 8 and of cutoff spring 19 further in the direction toward core 4.

At instant $t_2$, shortly before the end of the opening phase, current pulse 30 is supplied which delivers the electrical power necessary to accelerate armature 7 and valve needle 10 against total spring energy $F_{tot}$ of resetting spring 8 and of cutoff spring 19 further in the direction toward core 4. Armature 7 strikes against core 4. Total spring energy $F_{tot}$ of resetting spring 8 and of cutoff spring 19 is now available for the closing operation.

The present invention is not restricted to the example shown of a fuel injector 1 for carrying out the method of the present invention, and can also be implemented when working with a multitude of other types of construction of fuel injectors 1, particularly for fuel injectors 1 opening outwardly.

What is claimed is:

1. A method for operating a fuel injector for a fuel injection system of an internal combustion engine, the fuel injector including a magnetic coil, an armature acted upon in a closing direction by a resetting spring, and a valve needle, frictionally connected to the armature, for actuating a valve-closure member which, together with a valve-seat surface, forms a sealing seat, the method comprising:

exciting the magnetic coil with a basic current intensity during an opening phase of the fuel injector;

exciting the magnetic coil with a current pulse before an end of the opening phase and after the exciting of the magnetic coil with the basic current, the current pulse having an intensity that is greater than an intensity of the basic current; and switching off current exciting the magnetic coil at an end of the opening phase.

2. The method according to claim 1, further comprising:

directly injecting fuel into a combustion chamber of an internal combustion engine using the fuel injector.

3. The method according to claim 1, further comprising:

providing a cutoff spring which cooperates with the resetting spring so that spring energies of the resetting spring and the cutoff spring add up after exceeding a partial lift of the armature.

4. The method according to claim 3, wherein at the end of the opening phase, the current pulse acts upon the armature and the valve needle so that the cutoff spring becomes biased.

5. The method according to claim 1, further comprising:

applying an elastically deformable layer on an armature stop face of at least one of a core and the armature.

6. The method according to claim 1, further comprising:

exciting the magnetic coil by a further current pulse at the beginning of the opening phase, an intensity of the further current pulse being greater than the intensity of the basic current.

7. The method according to claim 6, wherein an average electrical power of the current pulse and the further current pulse does not exceed a predefinable maximum value.

8. A method for operating a fuel injector for a fuel injection system of an internal combustion engine, the fuel injector including a magnetic coil, an armature acted upon in a closing direction by a resetting spring, and a valve needle, frictionally connected to the armature, for actuating a valve-closure member which, together with a valve-seat surface, forms a sealing seat, the method comprising:

exciting the magnetic coil with a basic current intensity during an opening phase of the fuel injector;

exciting the magnetic coil with a current pulse before an end of the opening phase, the current pulse having an intensity that is greater than an intensity of the basic current;

switching off current exciting the magnetic coil at an end of the opening phase; and providing a cutoff spring which cooperates with the resetting spring so that spring energies of the resetting spring and of the cutoff spring add up after exceeding a partial lift of the armature.

9. The method according to claim 8, wherein at the end of the opening phase, the current pulse acts upon the armature and the valve needle so that the cutoff spring becomes biased.

10. A method for operating a fuel injector for a fuel injection system of an internal combustion engine, the fuel injector including a magnetic coil, an armature acted upon in a closing direction by a resetting spring, and a valve needle, frictionally connected to the armature, for actuating a valve-closure member which, together with a valve-seat surface, forms a sealing seat, the method comprising:

exciting the magnetic coil with a basic current intensity during an opening phase of the fuel injector;

exciting the magnetic coil with a current pulse before an end of the opening phase, the current pulse having an intensity that is greater than an intensity of the basic current;

switching off current exciting the magnetic coil at an end of the opening phase; and applying an elastically deformable layer on an armature stop face of at least one of a core and the armature.

11. A method for operating a fuel injector for a fuel injection system of an internal combustion engine, the fuel injector including a magnetic coil, an armature acted upon in a closing direction by a resetting spring, and a valve needle, frictionally connected to the armature, for actuating a valve-closure member which, together with a valve-seat surface, forms a sealing seat, the method comprising:

exciting the magnetic coil with a basic current intensity during an opening phase of the fuel injector;

exciting the magnetic coil with a current pulse before an end of the opening phase, the current pulse having an intensity that is greater than an intensity of the basic current;

switching off current exciting the magnetic coil at an end of the opening phase; and exciting the magnetic coil by a further current pulse at the beginning of the opening phase, an intensity of the further current pulse being greater than the intensity of the basic current.

12. The method according to claim 11, wherein an average electrical power of the current pulse and the further current pulse does does not exceed a predefinable maximum value.

* * * * *

UNITED STATES PATENT AND TRADEMARK OFFICE

CERTIFICATE OF CORRECTION

PATENT NO. : 6,622,705 B2
DATED : September 23, 2003
INVENTOR(S) : Stier et al.

It is certified that error appears in the above-identified patent and that said Letters Patent is hereby corrected as shown below:

Title page, Item [54] and Column 1, Line 1,
Change the title from "METHOD FOR OPERATING A FUEL INJECTION VALVE" to -- METHOD FOR OPERATING A FUEL INJECTOR --

Signed and Sealed this

Tenth Day of August, 2004

JON W. DUDAS
*Acting Director of the United States Patent and Trademark Office*